US005951202A

United States Patent [19]

Brown

[11] Patent Number: 5,951,202

[45] Date of Patent: Sep. 14, 1999

[54] SHORELINE EROSION-PREVENTING BANK INSTALLATION

[76] Inventor: Gregory Benn Brown, 105 Blinman St., New London, Conn. 06320

[21] Appl. No.: 08/851,378

[22] Filed: May 5, 1997

[51] Int. Cl.[6] ..... E02D 17/20

[52] U.S. Cl. ..... 405/19; 405/258

[58] Field of Search ..... 405/15, 16, 17, 405/18, 19, 258

[56] References Cited

U.S. PATENT DOCUMENTS

| | | | |
|---|---|---|---|
| 570,946 | 11/1896 | Neale | 405/19 |
| 1,039,579 | 9/1912 | Neames | 405/19 |
| 1,058,274 | 4/1913 | Tirapani | 405/19 |
| 1,691,848 | 11/1928 | Johnson | 405/19 |
| 2,143,461 | 1/1939 | Waring | 405/19 |
| 3,315,408 | 4/1967 | Fisher | 405/16 |
| 3,561,219 | 2/1971 | Nishizawa et al. | 405/19 |
| 3,722,222 | 3/1973 | Rinkel | 405/16 |
| 4,135,843 | 1/1979 | Umemoto et al. . | |
| 4,610,568 | 9/1986 | Koerner | 405/15 |
| 5,024,560 | 6/1991 | Reilly . | |
| 5,064,313 | 11/1991 | Risi et al. . | |
| 5,405,217 | 4/1995 | Dias et al. . | |
| 5,507,845 | 4/1996 | Molnar et al. . | |
| 5,575,588 | 11/1996 | Nakamura | 405/15 |
| 5,786,281 | 7/1998 | Prunty et al. | 405/15 |

OTHER PUBLICATIONS

"Westerly trying synthetic barriers to resist the tide of Atlantic storms," newspaper article by Heather Tierney, in The Day, Nov., 1993.

"Landlok® Fiber Roving System," product brochure of Synthetic Industries, Sep., 1996.

"Landlok® Degradable Erosion Control Blankets," product brochure of Synthetic Industries, Dec., 1996.

"PYRAMAT® Permanent Erosion and Reinforcement Matrix," product brochure of Synthetic Industries, 1995.

"*Smart Solutions in Synthetics*® The Task Force for Engineered Geosynthetic Products," product brochure of Synthetic Industries, 1996.

"Landlok® Turf Reinforcement Mats," product brochure of Synthetic Industries, Feb., 1996.

"Landlok® Erosion Mat," product brochure of Synthetic Industries, Nov., 1994.

*Primary Examiner*—David J. Bagnell
*Assistant Examiner*—Frederick L. Lagman
*Attorney, Agent, or Firm*—Albert Peter Durigon

[57] ABSTRACT

The instant shoreline erosion-preventing bank installation comprises a vegetation supporting strengthened skin having negatively-buoyant bottom and side drop-skirts, which skirts each include an extendable reservoir of skin folded on itself accordion-like, and which skirts each include at least one weight. The side and bottom negatively-buoyant drop-skirts of the vegetation supporting strengthened skin fall as the bank is eroded by wave action, conforming the skin to the bank as it erodes in a storm, thereby preventing wash-away of the installation. Energy absorbing and flow control weighted ballasts are attached to the skin; which, among other things, control wave and wind action in a storm so as to prevent wash-off to, and erosion of, adjacent property that may be unprotected. In time, the installation of the invention is completely overgrown with vegetation, permitting the use and enjoyment of the bank protected thereby, provides long term protection from erosion and provides a wildlife habitat.

17 Claims, 4 Drawing Sheets

SHORELINE EROSION-PREVENTING BANK INSTALLATION

FIELD OF THE INVENTION

The present invention is drawn to the field of hydraulic and earth engineering, and more particularly, to a novel shoreline erosion-preventing bank installation.

BACKGROUND OF THE INVENTION

The banks of dunes, cliffs and other shoreline properties are subject to highly undesirable erosion. Due to the cycling of temperature, moisture, freezing and other conditions, the surface layers thereof typically are unstable, and tend to creep downwardly in shear. Sooner or later their facings will "let go," sometimes giving rise to serious dislocations, unless steps are taken to secure the unstable surface layers against creep erosion.

It is known that the roots of vegetation planted along such banks tend to secure the unstable surface layers against creep erosion. In a storm, however, the banks of such shoreline properties are subjected to powerful winds and wave action, that often carries away the facing soil, and with it, any vegetation rooted therein.

So-called "armoring" techniques, such as those of U.S. Pat. No. 4,135,843 to Umemoto et al., U.S. Pat. No. 5,024,560 to Reilly, U.S. Pat. No. 5,064,313 to Risi et al., and U.S. Pat. No. 5,405,217 to Dias et al., have attempted to prevent shoreline erosion by so fortifying the shoreline with blocks, plantable cement structures, fabric nets, high density weighted polymer mattresses, weighted cylindrical geocells and the like as to form a prophylactic layer over the region of the shoreline that would otherwise be subject to the erosive effects of the moving water and wind. Due to their weight and bulk, such armoring techniques are often difficult to install. Often, they are so configured as to prevent the enjoyment of the region of the shoreline that they overlay. Moreover, there is the difficulty of being able to adequately anchor the armor to the underlying soil. Water incident to the layer is accelerated in such way as to wash away beach at the beach/armor interface, thereby degrading adjacent, unprotected property. And the prophylactic layer itself is subjected to being washed away in a severe storm, or could collapse due to natural shifts in the embankment material or from landslides due to heavy rains.

SUMMARY OF THE INVENTION

The present invention discloses as its principal object a novel shoreline erosion-preventing bank installation that stabilizes the banks of dunes, cliffs and other shoreline properties against surface dislocations; that is unobtrusive, permitting the enjoyment of the bank to which it is installed; that conforms to the bank as it may naturally shift or as it erodes in a storm, preventing wash-away of the installation while always protecting the bank; and that so controls wave and wind action in a storm as to prevent wash-off to, and erosion of, adjacent property that may be unprotected.

In accord with this and other objects, the shoreline erosion-preventing bank installation of the present invention comprises a vegetation supporting strengthened skin having negatively-buoyant bottom and side drop-skirts. In the presently preferred embodiment, the vegetation supporting strengthened skin includes a plantable layer of a geotextile material and a strengthening overlayer of a corrosion-resistant metallic mesh. The roots of the vegetation hold the underlying soil in place against surface erosion, the layer of geotextile material holds the vegetation, and the strengthening overlayer of corrosion-resistant metallic mesh holds the layer of the geotextile material in place on the bank to be protected. A few months after planting, the installation is completely covered over by unobtrusive vegetation, permitting the enjoyment of the bank to which it is installed, provides long-term protection from erosion and provides a natural habitat for wildlife.

In the presently preferred embodiment, the negatively-buoyant bottom drop-skirt of the vegetation supporting strengthened skin includes an extendable reservoir of skin folded on itself accordion-like, to which a weighted bladder is attached, and the negatively-buoyant side drop-skirts of the vegetation supporting strengthened skin each include an extendable reservoir of skin folded on itself accordion-like, to which discrete weights in one portion thereof and an elongated weighted bladder in another portion thereof are attached, which weights and weighted bladder are pendulously hung off of a support cable anchored into the bank to be protected. The side and bottom negatively-buoyant drop-skirts fall as the bank is eroded by wave action or as it naturally shifts, conforming the skin to the bank as it may naturally shift or erodes in a storm, thereby preventing wash-away of the installation in a storm while always protecting the bank.

In the presently preferred embodiment, the vegetation supporting strengthened skin having negatively-buoyant bottom and side drop-skirts defines a superjacent "overwash" area and a subjacent "main" area. The vegetation supporting strengthened skin having negatively-buoyant bottom and side drop-skirts is attached to the bank to be protected in the overwash area thereof, preferably by staples, which prevents undergrowth and the like from pushing-off the skin. The vegetation supporting strengthened skin having negatively-buoyant bottom and side drop-skirts is attached to the bank to be protected in one part of the main area thereof, preferably by anchor piles, which prevents undergrowth and the like from pushing-off the skin and prevents "gross" bank dislocation in shear, but is "floating," and unattached, in another part of the main area thereof, which permits the skin in the unattached part of the main area, preferably proximate the ocean, to freely conform to the bank to be protected. Energy absorbing and flow control weighted ballasts are attached to the skin in the unattached part of the main area, which not only hold the skin conformably against the natural grade of the bank to be protected, which prevents undergrowth and the like from pushing-off the skin, but also so control wave and wind action in a storm as to prevent wash-off to, and erosion of, adjacent property that may be unprotected.

BRIEF DESCRIPTION OF THE DRAWINGS

Other objects, advantageous features and inventive aspects of the present invention will become apparent as the invention becomes better understood by referring to the following detailed description of the presently preferred embodiments thereof, and to the drawings, wherein.

DETAILED DESCRIPTION OF THE PREFERRED EMBODIMENTS

Figure 1:
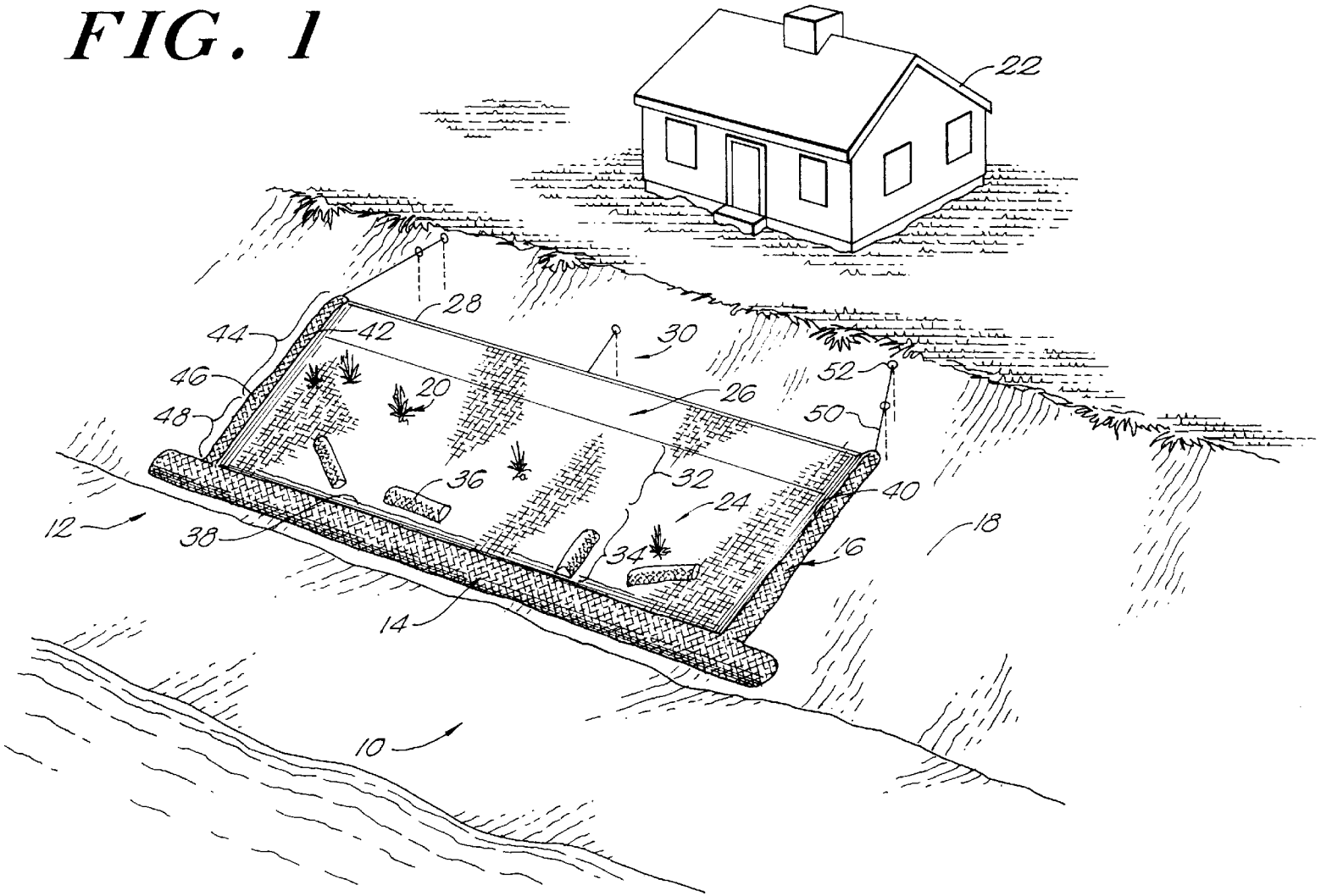
FIG. 1 is a pictorial view of the shoreline erosion-preventing bank installation of the present invention, illustrating the bottom and side drop-skirts in their folded condition.

Referring now to FIG. 1, generally designated at 10 is a pictorial view of the shoreline erosion-preventing bank installation of the present invention. A vegetation supporting strengthened skin generally designated 12 having negatively-buoyant bottom and side drop-skirts generally designated 14, 16 is draped over bank 18 to be protected against erosion. Vegetation generally designated 20 grows through the skin 12 into embankment 18, securing the unstable surface layer thereof against erosion, and a house 22 on embankment 18 overlooks the shore.

Figure 2:
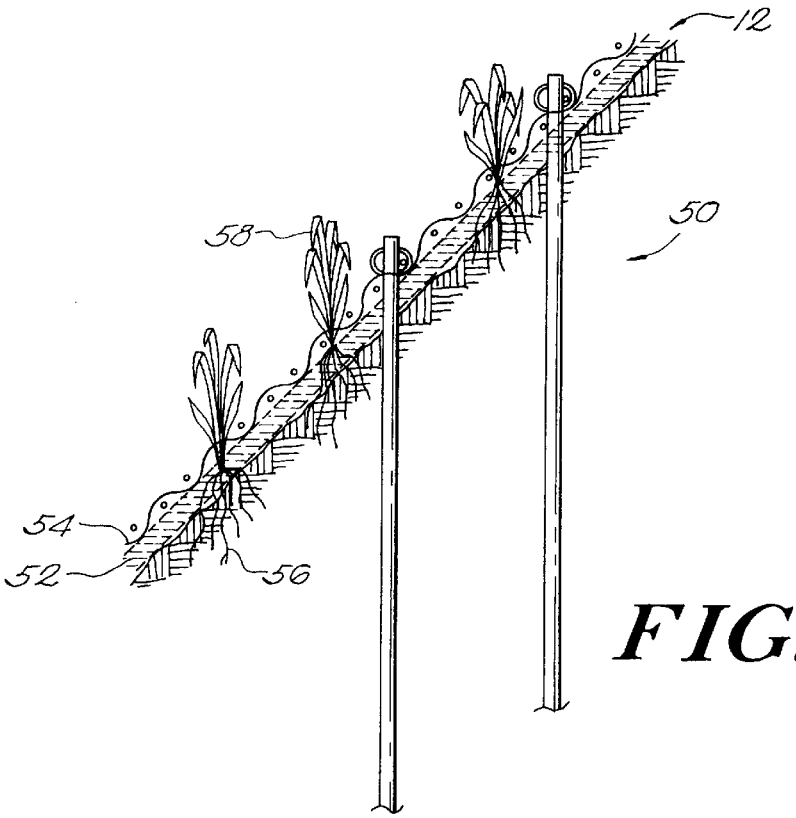
FIG. 2 is a pictorial diagram of the vegetation supporting strengthened skin of the shoreline erosion-preventing bank installation of the present invention.

Referring now briefly to FIG. 2, generally designated at 50 is a schematic diagram illustrating the vegetation supporting strengthened skin of the shoreline erosion-preventing bank installation of the present invention. In the presently preferred embodiment, the vegetation supporting strengthened skin includes a plantable layer of a geotextile material 52, such as the Landlok® Erosion Mat commercially available from Synthetic Industries, and a strengthening overlayer of a corrosion-resistant metallic mesh 54. The roots 56 of the vegetation 58 hold the underlying soil in place against surface erosion, the layer of geotextile material 52 holds the vegetation 58, and the strengthening overlayer of corrosion-resistant metallic mesh 54 holds the layer of the geotextile material 52 in place on the bank 18 to be protected. A few months after planting, the installation of the invention is substantially completely covered over by unobtrusive vegetation, permitting the enjoyment of the bank to which it is installed, provides long-term protection from erosion and provides a wildlife habitat.

Figure 3:
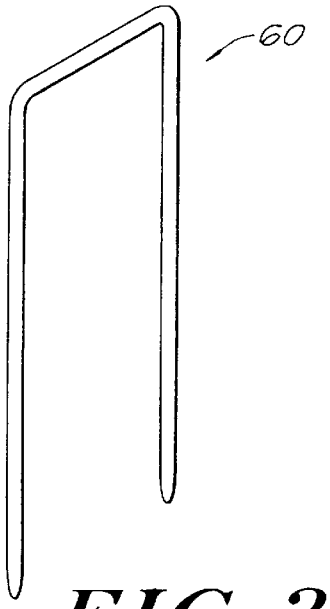
FIG. 3 is a perspective view illustrating an exemplary attachment staple of the shoreline erosion-preventing bank installation of the present invention.

Returning now to FIG. 1, the vegetation supporting strengthened skin 12 defines a main body portion generally designated 24, proximate the ocean, and a superjacent overwash body portion generally designated 26, remote from the ocean. The overwash body portion 26 of the vegetation supporting strengthened skin 12 is attached to the bank 18, preferably by staples generally designated 50 in FIG. 3, which prevents undergrowth and the like from pushing-off the skin. Any attachment device or technique other than attachment staples may be employed without departing from the inventive concepts.

Preferably, the top edge of the skin 12 of the overwash body portion 28 is sandwiched between rot-resistant (pressure-treated) boards 28, which, depending on soil type and other factors, may be anchored by one or more auxiliary support cable and pin terminations generally designated 30.

In a typical installation, the overwash body may be about six (6) to eight (8) feet high and about one hundred (100) feet across.

Figure 4:
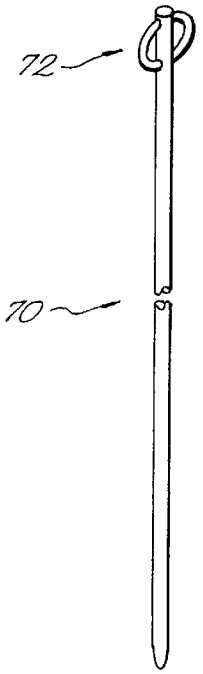
FIG. 4 is a perspective view illustrating an exemplary anchor pile of the shoreline erosion-preventing bank installation of the present invention.

One part of the main body portion 24 of the vegetation supporting strengthened skin 12 that preferably is remote from the sea as schematically illustrated by a bracket designated 32 is attached to the bank 18 by anchor piles generally designated 70 in FIG. 4, but another part of the main body portion 24 of the vegetation supporting strengthened skin 12 that preferably is proximate the sea as schematically illustrated by a bracket designated 34 is unattached to the bank 18 and is "floating." The anchor piles 70 prevent "gross" bank dislocation in shear, such as landslides, the vegetation held by the vegetation supporting strengthened skin 12 in the attached part 32 of the main body 24 takes root and grows into the underlying soil, without pushing the skin off of the facing of the bank 18, and the vegetation supporting strengthened skin 12 in the unattached part 38 of the main area 24 freely floats on the bank, allowing that portion to conform to the bank to be protected as it naturally shifts or is eroded in a storm, without thereby undermining the installation.

In a typical installation, the attached part 32 of the main body 24 of the skin 12 may be about eight (8) feet by one-hundred (100) feet, and the unattached part 34 of the main body 24 of the skin may be about sixteen (16) feet by one-hundred (100) feet.

Referring now briefly to FIG. 4, the anchor piles 70 preferably have tie hoop flange ends generally designated 72 that allow the anchors to be braced together and that provide abutments that hold the skin tightly on the bank to be protected. In the typical installation, the anchor piles are about seven (7) to ten (10) feet in length. Any suitably configured tie and/or flanged ends may be employed without departing from the inventive concepts. Flexible or rigid brackets, not shown, may be attached to the top of adjacent pilings for added anchoring strength.

Returning now to FIG. 1, energy absorbing and flow control weighted ballasts 36 are attached to the skin 12 in the unattached part 34 of the main body 24, which not only hold the skin 12 in the unattached part 34 of the main body 24 against the bank to be protected, allowing the vegetation supported thereby to root into and grow out of the underlying soil without thereby pushing the skin thereoff, but also absorb wave energy and control wave and wind action in a storm. As illustrated, the energy absorbing and flow control weighted ballasts 36 may be arrayed on the skin 12 either horizontally, where they are parallel to the bottom edge of the installation, vertically, where they are parallel to the side edge of the installation, or at an angle thereto. Their arrangement controls the manner of water run-off, and it is preferred that the laterally outermost ones thereof be angled to face inwardly, as illustrated, so that back-wash water incident thereto is directed away from the sides of the installation, to prevent wash-off to, and erosion of, adjacent property that may be unprotected. The ballasts 36 may be pendulously suspended on anchor piles where necessary, not shown. The ballasts 36 may also be temporary, such as a sewn fabric containing water, which water then weeps thereinthrough adding moisture for vegetation growth, or the same may be drained and removed completely at a later time when the vegetation is established, allowing the vegetation to fill in the area previously occupied by the ballasts.

In a typical installation, the ballasts 36 are about three (3) feet by six (6) feet by two (2) feet, and may weigh from about fifty (50) pounds to two-thousand (2000) pounds.

Figure 5:
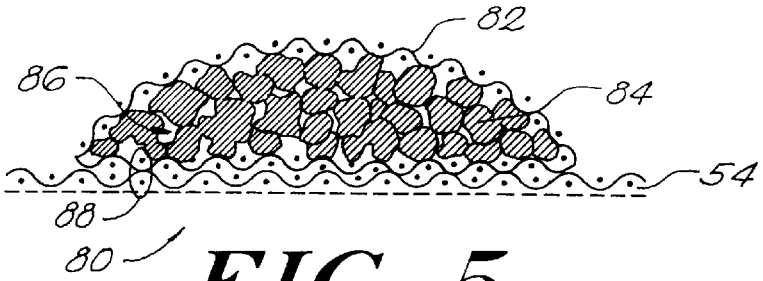
FIG. 5 is a side sectional view illustrating an exemplary energy absorbing and flow control weighted ballast of the shoreline erosion-preventing bank installation of the present invention.

Referring now briefly to FIG. 5, generally designated at 80 is a side sectional view of an exemplary energy absorbing and flow control weighted ballast of the shoreline erosion-preventing bank installation of the present invention. The ballast 80 includes a wire mesh skin 82 defining an enclosure into which irregularly shaped rocks 84 are disposed defining interrock cavities generally designated 86 therebetween. The skin 82 of the ballasts 80 may be attached to the wire mesh 54 by wire-weaves schematically illustrated by an ellipse designated 88, or in any other suitable manner. The cavities 88 absorb the energy of incident water waves. Any other ballast construction may be employed, such as a fabric liner with enclosed sand bags or a custom-designed concrete component, without departing from the inventive concepts.

Returning now to FIG. 1, in the presently preferred embodiment, the negatively-buoyant bottom drop-skirt 14 of the vegetation supporting strengthened skin 12 includes an extendable reservoir 38 of skin folded on itself accordion-like, to which an elongated weighted bladder 40 is attached, and the negatively-buoyant side drop-skirts 16 of the vegetation supporting strengthened skin 12 each include an extendable reservoir 40 of skin folded on itself accordion-like, to which discrete weights 42 in an upper portion thereof schematically illustrated by bracket 44 and an elongated weighted bladder 46 in a lower portion thereof schematically illustrated by bracket 48 are attached, which weights 42 and weighted bladder 46 are pendulously hung off of at least one support cable 50 anchored by piles 52 into the bank 18 to be protected. Preferably, there is from about five (5) feet to fifteen (15) feet of extendable material in the reservoirs. It will be appreciated that the reservoirs of extendable material may be folded on itself in other than an accordion-like manner without departing from the inventive concepts.

In a typical case, the portion 44 may be about eighteen (18) to twenty three (23) feet, the portion 48 may be from six (6) to ten (10) feet in length, and the weights 42 may be sand filled bags, rocks, custom designed concrete members or other weights without departing from the inventive concepts. The bottom and side negatively-buoyant drop-skirts 14, 16 fall as the bank is eroded by wave action in a manner to be described, or naturally shifts, conforming the skin 12 to the bank as it erodes in a storm or as it naturally shifts, thereby preventing the undermining of the installation and the wash-away of the bank material in a storm.

These features are most critical and functional while the vegetation is being established, but are less critical as the vegetation is established over time. After one or more storm cycles or naturally occurring shifts, the skirts become covered over, forming a buried perimeter that acts as an extensive anchor of the whole installation.

To prevent storm damage to the bladder of the bottom drop-skirt and to further protect the bank and installation against erosion, the Shoreline Erosion-Reversing System and Method of copending, allowed U.S. utility patent application Ser. No. 08/467,027, filed Jun. 6, 1995, now U.S. Pat. No. 5,636,939 of the same inventive entity as herein, incorporated herein by reference, may advantageously be employed.

Figure 6A:
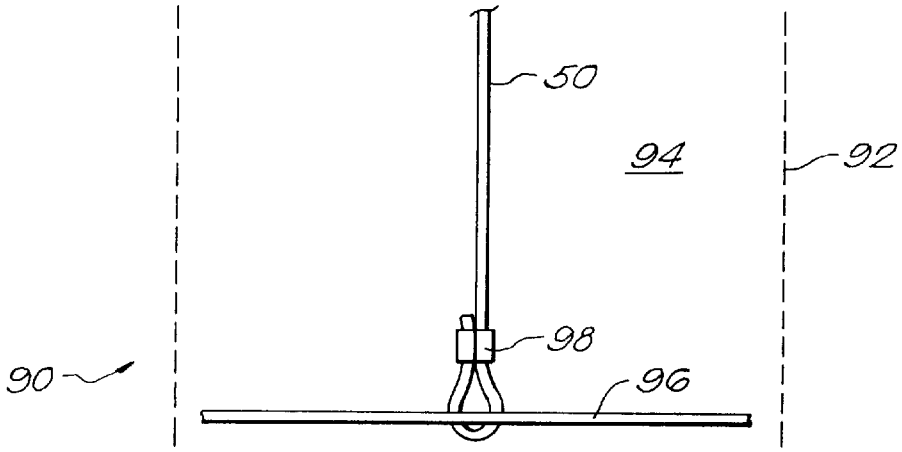
FIG. 6 in the FIG. 6A and 6B thereof respectively are schematic end and sectional views illustrating an exemplary weighted bladder of the shoreline erosion-preventing bank installation of the present invention.
Figure 6B:
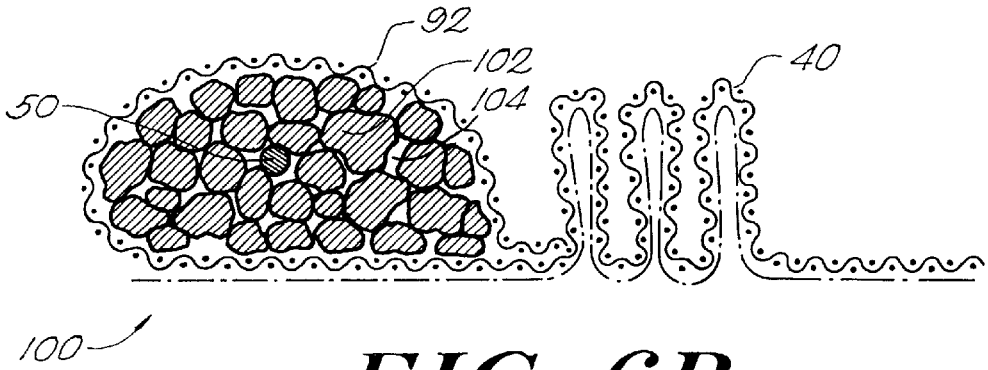

Referring now to FIG. 6, generally designated at 90 in the FIG. 6A and at 100 in the FIG. 6B thereof respectively are schematic end and sectional views illustrating an exemplary elongated weighted bladder of the side drop-skirt of the shoreline erosion-preventing bank installation of the present invention. The bladder includes a metal mesh skin 92 closed on itself to provide a generally cylindrical enclosure generally designated 94 through which support cable 50, terminated at end plate 96 by clamp 98, extends. Irregularly shaped rocks 102 are disposed therein and define interrock cavities generally designated 104. The cavities 104, like the cavities 86 (FIG. 5), absorb the energy of incident water waves in a storm. Any other ballast construction may be employed, such as a fabric liner with enclosed sand bags or custom-designed concrete components, without departing from the inventive concepts. As will readily be appreciated, the ballast of the bottom drop-skirt is substantially identical to that of the side drop-skirts, except that it does not have the support cable 50.

Figure 7:
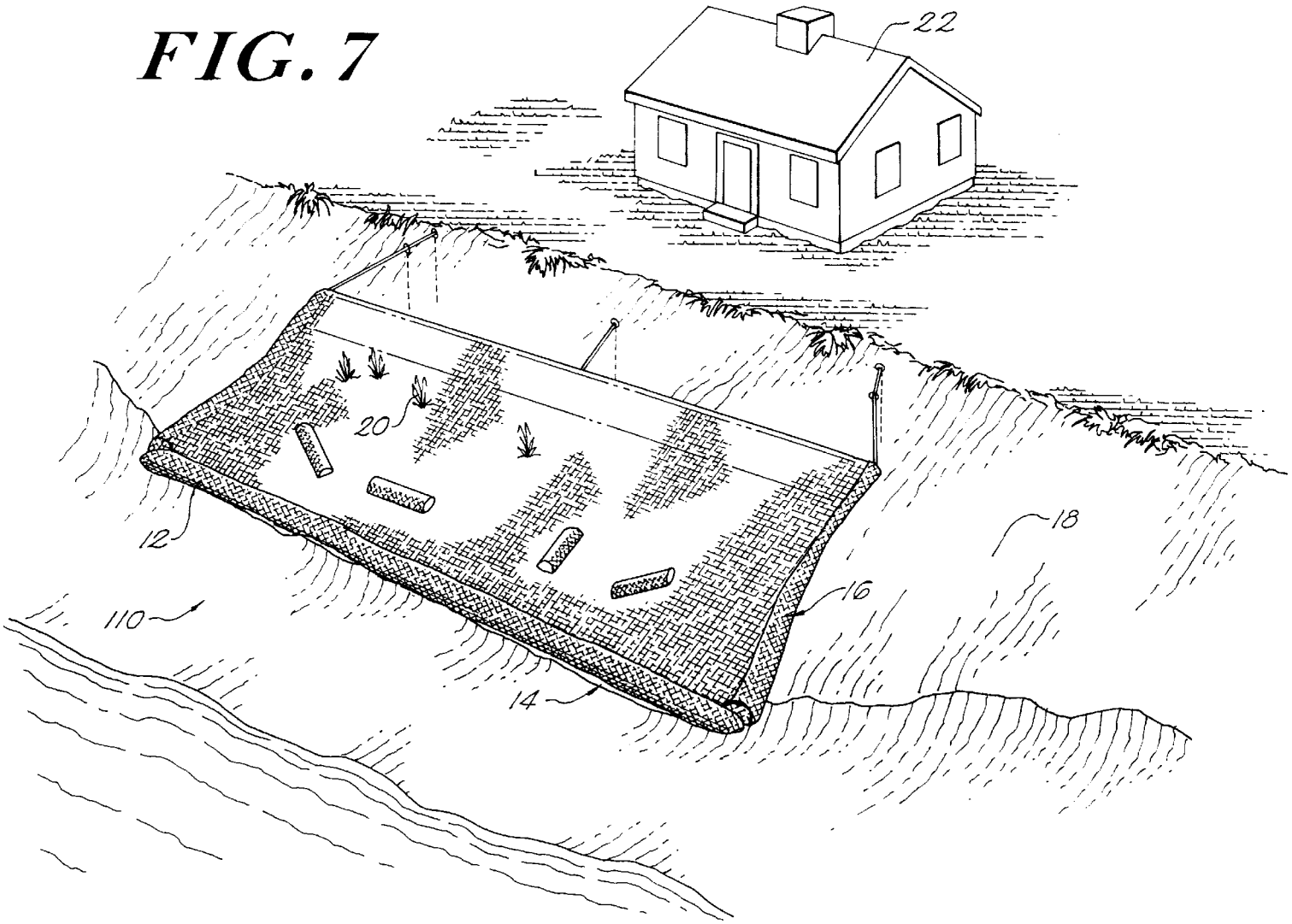
FIG. 7 is a pictorial view of the shoreline erosion-preventing bank installation of the present invention, illustrating the bottom and side drop-skirts in their unfolded condition.

Referring now to FIG. 7, generally designated at 110 is a pictorial view of the shoreline erosion-preventing bank installation of the present invention, illustrating the bottom 14 and side drop-skirts 16 in their unfolded condition. As illustrated, the bottom and side drop-skirts 14, 16 are partially unfolded, protecting the bottom and sides of the installation against the erosive effects of the wind and water of a storm. The side and bottom negatively-buoyant drop-skirts continue to fall as the bank is eroded by wave action, conforming the skin to the bank as it erodes in the storm, thereby preventing undermining of the installation and wash-away of the bank material.

To install the preferred embodiment of the bank installation of the present invention, first any vegetation on the bank to be protected is cut to ground level, and is lightly mulched or otherwise conditioned. The support pins holding the top edge of the skin in the overwash area, when used, are then placed into the bank, and the geotextile is sewn together and draped over the bank. The geotextile is then lightly mulched, and the wire mesh sections are clipped, woven, or otherwise fastened to form a continuous sheet over the geotextile. The staples are then driven through the overwash body of the skin and the anchor pilings are then driven through the attached part of the main body of the skin. The installation is then completed, by attaching the side and bottom drop-skirts. The bladders and ballasts preferably are preassembled off-shore, and after their attachment, are filled with weight, and the weights are attached to the upper portion of the side drop-skirts. The installation is then mulched, seeded and/or planted with suitable vegetation, such as Crown Vetch or various grasses.

Many modifications of the presently disclosed invention will become apparent to those skilled in the art having benefit of the instant disclosure. It will be appreciated that the invention has application to properties other than shoreline properties, such as river banks or canal ledges, or wherever banks need protection from water or landslides.

What is claimed is:

1. An erosion-preventing bank installation, comprising:

a vegetation supporting strengthened skin having negatively-buoyant bottom and side drop-skirts;

said negatively-buoyant bottom drop-skirt of the vegetation supporting strengthened skin includes a reservoir of extendable material, to which at least one weight is attached; and said negatively-buoyant side drop-skirts of the vegetation supporting strengthened skin each include a reservoir of extendable material, to which at least one weight is attached;

wherein said material of said extendable reservoir of said negatively-buoyant bottom drop-skirt of the vegetation supporting strengthened skin includes skin folded on itself accordion-like; and wherein said material of said extendable reservoir of said negatively-buoyant side drop-skirts of the vegetation supporting strengthened skin includes skin folded on itself accordion-like;

whereby the side and bottom negatively-buoyant drop-skirts fall as the bank is eroded by wind and wave action of a storm, conforming the skin to the bank as it erodes in the storm, thereby preventing wash-away of the installation.

2. The invention of claim 1, wherein the vegetation supporting strengthened skin includes a plantable layer of a geotextile material and a strengthening overlayer of a corrosion-resistant metallic mesh, whereby the roots of vegetation planted in the geotextile material hold the soil of the bank to be protected in place against surface erosion, the layer of geotextile material holds the vegetation, and the strengthening overlayer of corrosion resistant metallic mesh holds the layer of the geotextile material in place on the bank to be protected.

3. The invention of claim 1, wherein said at least one weight of said negatively-buoyant bottom drop-skirt of the vegetation supporting strengthened skin includes an elongated weighted bladder.

4. The invention of claim 1, wherein said at least one weight of said negatively-buoyant side drop-skirts of the vegetation supporting strengthened skin include discrete weights in one portion thereof and an elongated weighted bladder in another portion thereof, which weights and weighted bladder are pendulously hung off of a support cable anchored into the bank to be protected.

5. The invention of claim 4, wherein the vegetation supporting strengthened skin having negatively-buoyant bottom and side drop-skirts defines a superjacent overwash area and a subjacent main area, and wherein the vegetation supporting strengthened skin having negatively-buoyant bottom and side drop-skirts is attached to the bank to be protected in the overwash area thereof.

6. The invention of claim 5, wherein the vegetation supporting strengthened skin having negatively-buoyant bottom and side drop-skirts is attached to the bank to be protected in the overwash area thereof by attachment staples.

7. The invention of claim 1, wherein the vegetation supporting strengthened skin having negatively-buoyant bottom and side drop-skirts defines a superjacent overwash area and a subjacent main area, and wherein the vegetation supporting strengthened skin having negatively-buoyant bottom and side drop-skirts is attached in one part of the main area thereof to the bank to be protected, but is floating, and unattached, in another part of the main area thereof, which permits the skin in the unattached part of the main area to freely conform to the bank to be protected as it may naturally shift or erode in a storm.

8. The invention of claim 7, wherein the vegetation supporting strengthened skin having negatively-buoyant bottom and side drop-skirts defines a superjacent overwash area and a subjacent main area, and wherein the vegetation supporting strengthened skin having negatively-buoyant bottom and side drop-skirts is attached in one part of the main area thereof to the bank to be protected by anchor piles, which anchor piles protect the bank against gross shear dislocation.

9. The invention of claim 8, wherein said anchor piles have end attachment flanges.

10. The invention of claim 1, wherein the vegetation supporting strengthened skin having negatively-buoyant bottom and side drop-skirts defines a superjacent overwash area and a subjacent main area, and wherein the vegetation supporting strengthened skin having negatively-buoyant bottom and side drop-skirts is attached in one part of the main area thereof to the bank to be protected, but is floating, and unattached, in another part of the main area thereof, which permits the skin in the unattached part of the main area to freely conform to the bank to be protected, and further includes at least one energy absorbing and flow control weighted ballast in the unattached part of the main area, which not only hold the skin against the bank to be protected, but also to control wave and wind action in a storm as to prevent wash-off to, and erosion of, adjacent property that may be unprotected.

11. The invention of claim 10, wherein said at least one energy absorbing and flow control weighted ballast is attached to the skin in the unattached part of the main area thereof.

12. An erosion-preventing littoral installation, comprising:

a negatively-buoyant drop-skirt;

said negatively-buoyant drop-skirt includes a reservoir of extendable skirt material, to which reservoir at least one weight is attached, which weight extends the extendable skirt material of the reservoir of extendable material of the drop-skirt allowing said negatively-buoyant drop-skirt to drop as the littoral area is eroded and naturally shifts over time such that the extendable skirt material of the reservoir of extendable skirt material pays out of the reservoir over the littoral area, protecting the littoral area, as the littoral area erodes and shifts over time;

whereby said negatively-buoyant drop-skirt falls as the littoral area is eroded and naturally shifts over time conforming the drop-skirt to the littoral area as it erodes and naturally shifts, thereby protecting the installation area.

13. The erosion-preventing littoral installation of claim 12, wherein said negatively-buoyant drop-skirt is a bottom drop-skirt.

14. The erosion-preventing littoral installation of claim 12, wherein said negatively-buoyant drop-skirt is a side drop-skirt.

15. The erosion-preventing littoral installation of claim 12, further including a skin to which said negatively-buoyant drop-skirt is attached.

16. The erosion-preventing littoral installation of claim 15, wherein said skin is a vegetation supporting strengthened skin.

17. The erosion-preventing littoral installation of claim 12, further including a second negatively-buoyant drop-skirt.

* * * * *